US006257156B1

(12) United States Patent
Kaulamo

(10) Patent No.: US 6,257,156 B1
(45) Date of Patent: Jul. 10, 2001

(54) WIND BOX FOR A CHEMICAL RECOVERY FURNACE

(75) Inventor: Osmo Kaulamo, Varkaus (FI)

(73) Assignee: Osmo Kaulamo Engineering Oy, Varkaus (FI)

( * ) Notice: Subject to any disclaimer, the term of this patent is extended or adjusted under 35 U.S.C. 154(b) by 0 days.

(21) Appl. No.: 09/446,800

(22) PCT Filed: Jun. 22, 1998

(86) PCT No.: PCT/FI88/00547

§ 371 Date: Dec. 22, 1999

§ 102(e) Date: Dec. 22, 1999

(87) PCT Pub. No.: WO99/00627

PCT Pub. Date: Jan. 7, 1999

(30) Foreign Application Priority Data

Jun. 25, 1997 (FI) ..... 972745

(51) Int. Cl.[7] ..... F23N 3/02; F23L 13/00

(52) U.S. Cl. ..... 110/182.5; 110/297; 110/163; 162/272

(58) Field of Search ..... 110/182.5, 297, 110/314, 163, 173 R, 175 R; 422/185; 162/48, 272; 15/246

(56) References Cited

U.S. PATENT DOCUMENTS 4,099,471 * 7/1978 Sander et al. ..... 110/182.5
4,748,004 5/1988 Goodspeed .
4,838,182 * 6/1989 Goodspeed ..... 110/182.5
4,846,080 * 7/1989 Ross et al. ..... 110/182.5
5,001,992 3/1991 Higgins et al. .
5,167,192 * 12/1992 Pingel et al. ..... 110/182.5
5,307,745 * 5/1994 Higgins et al. ..... 110/182.5

FOREIGN PATENT DOCUMENTS 2 404 174 4/1979 (FR) .

* cited by examiner

*Primary Examiner*—Denise L. Ferensic
*Assistant Examiner*—K B. Rinehart
(74) *Attorney, Agent, or Firm*—Smith-Hill and Bedell

(57) ABSTRACT

The present document describes a wind box used in the air supply of a chemical recovery furnace, the wind box comprising a frame (1) having at least one air inlet opening (2) and at least one air supply opening (3) through which air is led from an air channel via the wind box to the recovery furnace. The wind box further comprises at least one combined actuator (25) for regulating the air flow through the wind box and for cleaning each air supply opening (3) as well as means (19, 21) for moving each actuator (25). The invention is based on using a cleaning head (15) smaller than the air supply opening (3) when cleaning the air supply opening (3), whereby its path instead of a longitudinal motion is determined to be curved such that one to and from motion of the cleaning head will rub of all deposit from both the upper and the lower edge of the air supply opening (3) and also from the area between these.

11 Claims, 3 Drawing Sheets

WIND BOX FOR A CHEMICAL RECOVERY FURNACE

The invention relates to a wind box comprising a frame having an air opening and means for cleaning the air opening and for controlling the air flow through the wind box. Such wind boxes are used in chemical recovery furnaces, such as the soda recovery boilers used in the cellulose industry, air being supplied into the furnace with the aid of wind boxes in the case of such boilers.

Soda recovery boilers are used when producing chemical pulp by the sulphate process. Hereby the wood material is pulped in a cooking liquor containing sodium sulphide and sodium hydroxide, such liquor being termed white liquor. A residue from the pulping process is a liquor called black lye which contains residual chemicals and organic material from the wood pulp. This black lye is concentrated and injected into the soda recovery boiler where the organic material is combusted at a high temperature. During combustion the chemicals contained in the black lye accumulate onto the bottom of the soda recovery boiler as a melt. From the boiler bottom the melt is taken to further processing in order to circulate the chemicals back into the pulping process. Excess thermal energy is also released during combustion, which is then recovered in a steam power plant.

In order to achieve as complete a combustion as possible and a process having high efficiency, a large amount of air is needed in the process. This replacement air is taken to the boiler via the line of air openings around said boiler by blowing. The air is brought to the air openings through an air channel surrounding the boiler via housings called wind boxes. The air flow is also generally regulated by means of the equipment contained in these wind boxes.

A problem with soda recovery boilers is the accumulation of black lye as deposit at the edges of the air openings. This accumulated deposit leads to an uneven air flow and thus to a reduced efficiency of the combustion process. If the deposit is not removed sufficiently often and thoroughly enough, it tends to form hard accumulations which are difficult to remove.

In accordance with the prior art, actuators cleaning the air openings are arranged in the wind boxes in addition to air flow regulators. Such actuators are described in, e.g. FI Patent Application No. 913132 and FI Patent Specification No. 74796. These solutions are characterized by a cleaning blade smaller than the air opening, which blade moves in a back and forth motion and whose angle of impact and thereby the part of the air opening being cleaned is varied between the impact motions. The problem with such solutions is the very complex mechanism required for changing the angle of impact, in addition to which a separate system for regulating the air flow is needed. Furthermore, it is usually impossible to clean the edge areas of the centre part of the oval air openings with this equipment, and in their rest position the cleaning heads usually unnecessarily restrict the air flow through the wind box.

Combined devices are also known which seek to simplify the construction of the wind box by combining in one and the same device both functions, regulation of the air flow and cleaning of the air opening. One such device is described in FI Patent Specification No. 62178. The operation of the device is based on a shaft which is inserted through the air opening and moves in the longitudinal direction and is furnished with wings at its end. The intention is to use these wings for cleaning the air opening and, by adjusting their angle, also for restricting the air flow. Even this solution is hampered by the complexity and the poor functionality of the construction. From FI Patent Specification No. 87270, a simpler combined device is also known whose operation is similarly based on a cleaning head fixed to a shaft moving along a longitudinal path. In this solution the cleaning end is adjusted such that it is nearly equal in size to the air opening, whereby the entire inner part of the air opening can be cleaned with one to-and-from movement, but not, however, the so called beard accumulating around the outer edges of the air opening. A further problem hampering this solution is that the large cleaning head easily gets stuck in the air opening, preventing the operation of the wind box.

The aim of the invention is to eliminate the drawbacks hampering the above-described prior art and to provide a wind box containing an entirely novel type of combined device for regulating the air flow and for cleaning the air opening.

The invention is based on that, instead of a longitudinal motion, the path of the cleaning head, which is smaller than the air opening, is determined as being curved such that with one to-and-from motion, the cleaning head rubs off the deposit from both the upper and the lower edge of the air opening and also from the area between these.

The invention offers considerable benefits. The construction of the device is most simple, for in addition to the cleaning head and the means for moving it, all that is needed is a fixed guide way which determines the path of the cleaning head. The path of the cleaning head can also be designed such that over some section of its path the cleaning head together with an air slide possibly connected thereto operates as a means for regulating the air flow. Thus, the device according to the invention combines the advantages of the above-described prior-art devices in a novel, superior manner. The device enables the cleaning of the so called beard accumulating at the upper and lower edge of the air opening as do devices with varying impact angles, and in addition it is also possible to clean the edge areas of the entire air opening, as with the device which is furnished with a cleaning head the size of the air opening. In the wind box according to the invention, the cleaning head can be pulled out of the travel path of the air flow, and even manual cleaning is possible via the conventional manual access port which remains free in the wind box. All in all, the invention makes it possible to achieve an excellent functionality of the air chamber simultaneously combining it with facilities for regulating the air flow in the same device in a most simple and reliable manner.

In the following, the invention is described in more detail by means of a number of examples and with reference to the annexed drawings.

Figure 1:
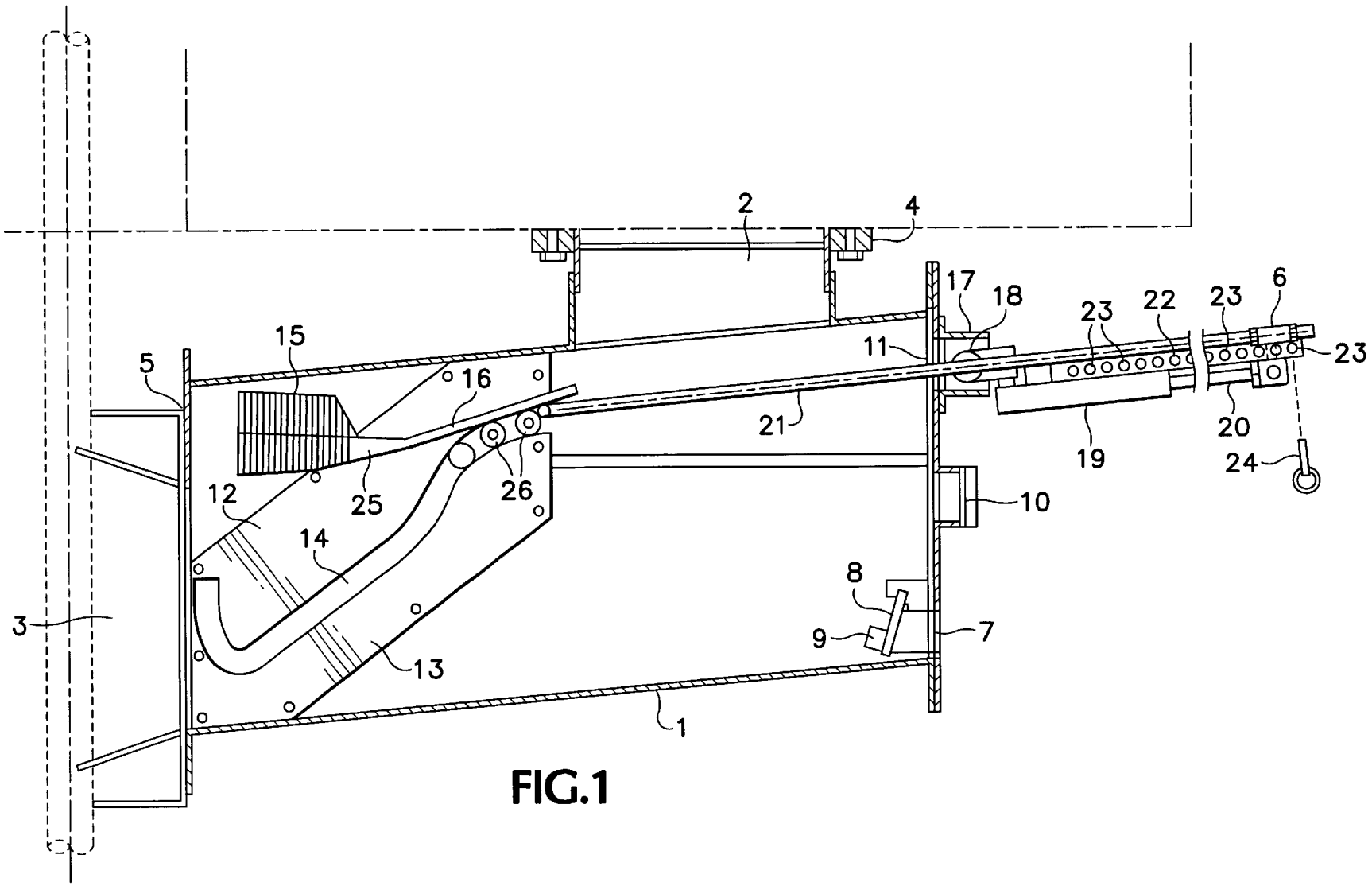
FIG. 1 is a cross-sectional view of a wind box according to the invention.

The wind box comprises a metal frame 1 and parts connected thereto either directly or via another part. The frame 1 is provided with an air inlet 2 and an air outlet 3, i.e. an air opening. The air inlet 2 is arranged at the upper part of the body 1 and is connected to an air supply channel (not shown) via which hot (about 140° C.) air is supplied to the wind box to be led further via the outlet 3 to the process chamber (not shown). The environment of the air inlet 2 and the outlet 3 is provided with fixing means 4 and 5 which are used to fix the wind box to the wall of the process chamber and to the system of air supply channels, simultaneously sealing these connections. The free internal width of the wind box frame 1 is advantageously equal to the maximal width of the air opening 3, and correspondingly, the internal width of the frame 1 is slightly greater than the maximal height of the air opening 3.

The back of the wind box frame 1 is provided with a manual access port 7 and a control port 11. The access port 7 makes it possible to clean the air opening even manually using a conventional sweeping method. The manual access port 7 is closed by means of a closing flap 8 hinged to the upper edge of the port 7, whereby a counterweight 9 is attached to the flap 8. The purpose of the counterweight 9 is to press the closing flap 8 against the access port 7 and to close the port 7 when the port 7 is not used for maintenance purposes. The control port 11 is an opening needed when operating the cleaning and control mechanism of the air opening 3. In addition, a round opening 10 for monitoring is provided between the control port 11 and the manual access port 7, whereby a glass window can be arranged in the opening for monitoring in order to enable a visual examination of the operation of the wind box and the air opening 3.

A hanger 17 is mounted at the mouth of the control port 11 external of the frame, a cylinder support 18 being hinged to the hanger such that the support 18 is capable of turning e.g. about 30 degrees round its support point in the vertical direction. An air cylinder 19 is fixed to the cylinder support 18 at its one end. The operation of the air cylinder 19 is controlled with normal control gear (not shown), whereby a shaft 20 fixed to the cylinder 19 piston can be pushed out of the cylinder 19 or pulled into the cylinder 19. A fixing device 6 is provided at the end of the shaft 20 which remains outside of the air cylinder 19 for connecting the shaft 20 to an operating rod 21.

The operating rod 21 is a rod whose task it is to transmit the movement and force transmitted from the air cylinder 19 via the shaft 20 further to actuators inside the wind box.

Figure 1A:
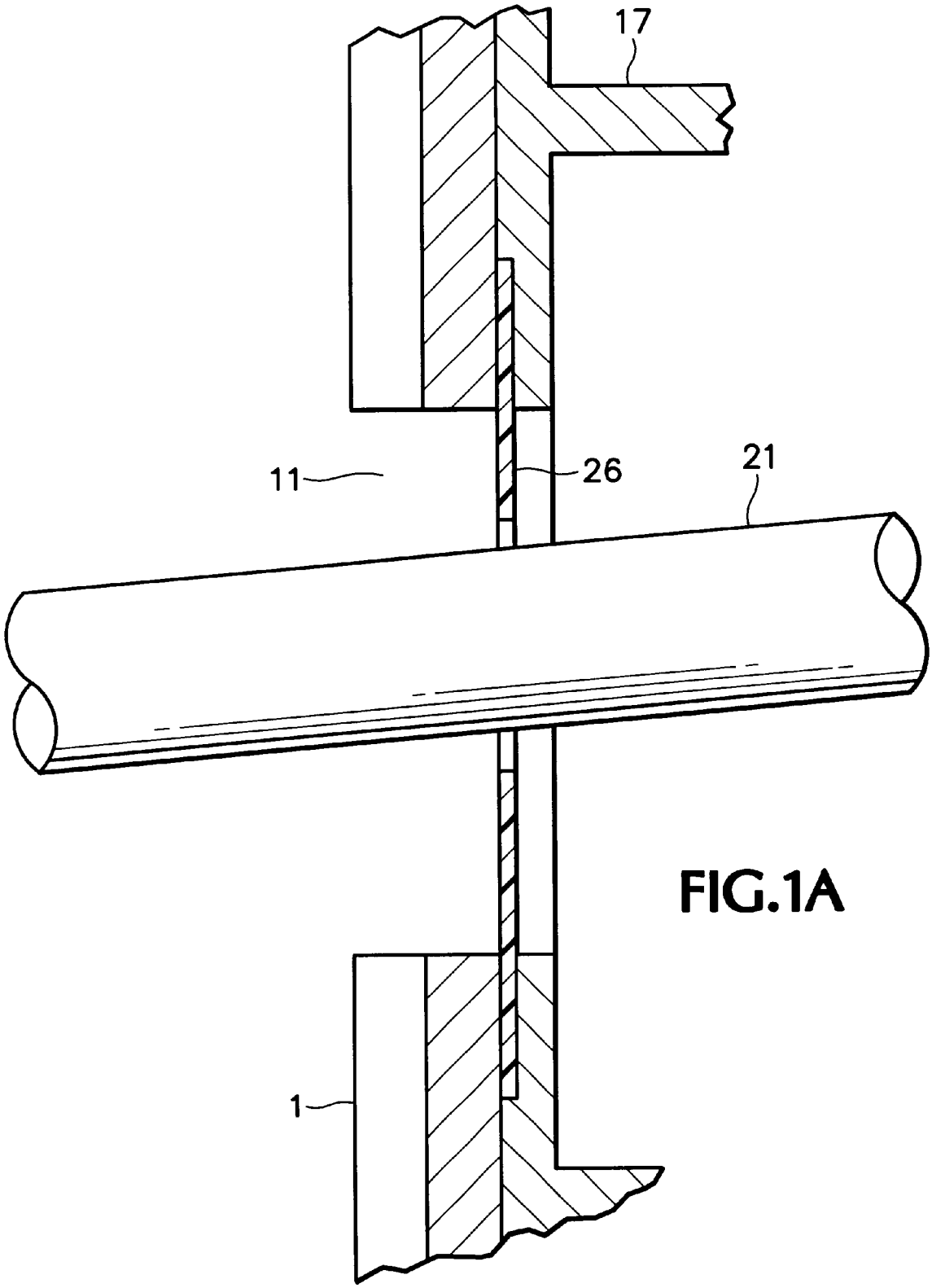
FIG. 1A illustrates a detail of FIG. 1.

The operating rod 21 extends from the fixing device 6 at the end of the shaft 20 to the cylinder support 18 and further via a hole in the support 18 and the control port 11 inside the wind box. The control port 11 is furnished with a gasket 26 (FIG. 1A) of Teflon® which reduces the leaking of the pressurized air flowing inside the wind box out of the wind box and through which the operating rod 21 passes. The gasket is fitted in the control port 11 such that the rotating motion of the gasket and a change in the direction of the centre axis of the hole through the gasket are possible.

A limiter frame 22 is mounted outside the control port 11, in the vicinity of the shaft 20 and the operating rod 21, essentially parallel with the shaft 20 and the operating rod 21, the limiter frame consisting of two parallel, elongated metal plates mounted at a distance from one another by means of support blocks, the plates having several holes 23 with matching positions. A spline or pin 24 limiting the movement of the shaft 20 out of the cylinder 19 and thereby also the movement of the operating rod 21 from inside the wind box frame 1, can be inserted through these holes 23.

Two metal plates 12 and 13 have been welded inside the frame 1 of the wind box on its side walls. The plates 12 and 13 are designed and positioned such that a gap of a certain shape in the longitudinal direction and having a width of about 30 to 35 mm remains between them, the gap forming the guide way 14. An actuating system 25 is arranged on the guide way 14, the actuating system 25 consisting of a cleaning head 15, an air slide 16, four wheels 26 and means for fixing the wheels 26. At its end on the side of the air slide 16 the actuator 25 is connected to the operating rod 21 by means of a joint which enables the actuator 25 and the operating rod 21 to turn with respect to each other.

The wheels 26 of the actuator 25, whose diameter is a bit smaller than the gap between the metal plates 12 and 13, are fixed to the air slide member 16 of the actuator 25, two at both edges of the slide 16. This construction makes it possible to move the actuator 25 back and forth along the guide way 14 in the following manner: when the air cylinder 19 is operated such that it pushes the shaft 20 out, the operating rod 21 moves outwards from the wind box simultaneously pulling the actuator 25 behind it along the guide way 14 and the actuator 25 thus follows the path determined by the guide way 14. When the air cylinder 19 pulls the shaft 20 inwards, the operation of the wind box is reversed. It should be noted that the hinged mounting of the air cylinder 19 to the frame 1 of the wind box via its support 18 together with the turning gasket (not shown) of the control port 11 make a component deviating from the longitudinal direction of the operating rod 21 possible for the movement of the actuator 25.

The shape of the guide way 14 is determined by the desired path of the actuator 25. In this embodiment the forward end of the guide way 14, this being the end which is situated farther away from the air opening 3, is slightly upwards slanted in the forward direction of the guide way 14 and is situated close to the upper edge of the wind box frame 1. Hereby both the air slide 16 and the cleaning head 15 are placed in the upper part of the wind box, where they do not disturb the air flow through the box. The shaft 20 of the air cylinder 19 is then pushed out.

When the pulling of the shaft 20 of the air cylinder 19 into the air cylinder is initiated, the actuator 25 enters the control area for the air flow. In this area the guide way 14 is slanted steeply downwards whereby, when the actuator 25 progresses along the guide way 14, the cleaning head 15 is pressed down restricting the air flow, and at the same time the air slide 16 closes the flow path of air over the cleaning head 15. If desired, the air flow in the wind box can be restricted by placing the spline 24 of the limiting frame 22 in a position corresponding to the desired air flow and by guiding the end of the operating rod 21, more specifically the fixing device 6 of the shaft 20 and the operating rod 21, against this spline 24 by means of the air cylinder 19.

When pushed forward on the guide way 14, the actuator 25 reaches the cleaning area. At the beginning of this area the guide way 14 is straight and progresses obliquely downwards at an angle which in the embodiment shown in the drawings deviates from the horizontal plane by about 35 to 40 degrees. In practical applications in general this angle may be about 20 to 60 degrees from the horizontal plane. When the actuator 25 progresses over the straight part of the guide way 14 the top of the cleaning head 15 approaches the lower edge of the air opening 3, encountering it and finally passing the lower edge at a small distance either without touching it or lightly rubbing the lower edge. The shape of the cleaning head 15 is such that at the encountering angle in question the intersecting line of the lower edge of the cleaning head 15 on the surface determined by the air opening 3 is essentially similar in shape to the lower edge of the air opening 3. Hereby the cleaning head 15, when passing the lower edge of the air opening, effectively removes deposits accumulated on this edge.

When the top of the cleaning head 15 has been pushed sufficiently far, typically 2 to 40 cm and in this embodiment about 10 to 20 cm, past the air opening 3, the actuator 25 reaches the steeply upward slanted section of the guide way. Hereby the cleaning head 15 begins to turn obliquely upwards and during this turning the edges of the cleaning head 15 rub off the deposit from the edges of the air opening 3. The end section of the guide way 14 is directed almost vertically upwards which makes it possible to clean also the upper edge of the air opening 3 during the same backward motion of the air cylinder 19. For cleaning the lower edge the cleaning head 15 usually protrudes about 2 to 40 cm past the upper edge of the air opening 3. In the embodiment depicted in the drawings the cleaning head 15 passes the upper edge by about 10 to 20 cm. The shape of the upper edge of the cleaning head 15 is also such that at the end point of the guide way 14 the intersectional line of the upper edge of the cleaning head 15 on the surface determined by the air opening 3 is essentially similar in shape to the upper edge of the air opening 3.

In this embodiment, the air opening 3 has roughly the shape of a vertically elongated hexagon with rounded corners. The maximum width of the air opening 3 is about 100 mm and its maximum height is about 300 mm. More generally, air openings 3 are typically elliptic or the like in shape and in more conventional installations they are rectangular in shape. The invention can be applied in connection with all these air openings by dimensioning the wind box and its actuators to correspond to the shape of opening in question.

The guide way 14 and the actuator 25 cleaning the air opening 3 and regulating the air flow in the wind box must be dimensioned such that the entire air opening 3 is cleaned. The width of the cleaning head 15 is determined by the width of the air opening such that the former is slightly narrower than the latter. The shapes of the upper and lower edges of the cleaning head 15 are determined by the path of the cleaning head 15 and the shape of the air opening 3 such that each sectional area of the plane determined by the surface of the air opening 3 and the cleaning head 15, when the cleaning head 15 travels through its entire intended path, is a sub-area of the surface determined by the air opening 3. At the same time the combination of these sectional areas is as close as possible to the surface determined by the air opening 3. In the present embodiment the cross-section of the cleaning head 15 essentially has the shape of a rhombus rounded at its upper and lower ends and standing on one end. The length of the cleaning head 15 is such that the cleaning head 15 can be inserted past the edges of the air opening 3 the above-described sufficient distances.

Also the other parts of the actuator 25 are dimensioned according to each application. The width of the air slide 16 which is fixedly connected to the rear part of the cleaning head 15 is determined by the free width of the inner part of the wind box frame 1 such that the former width is slightly narrower, and its length is determined such that when the actuator 25 is in position to regulate the air flow, the rear edge of the air slide 16 always extends close to the upper surface of the wind box frame 1. The wheels 26 are fixed to the air slide 16 to its both edges such that two wheels 26 are aligned with respect to one another and the other two are also aligned with respect to one another in the longitudinal direction of the air slide 16 at a distance of about 5 to 15 cm from the first pair of wheels.

Even solutions differing from the above-described embodiments are feasible within the scope of the invention.

The guide way 14 can also be implemented without wheels 26, for example by using slide rails. The way 14 can also be made from e.g. a bar along which the air slide 16 and the cleaning head 15 move supported by barrels. In wind boxes according to the invention the shape of the way 14 may also differ from what is depicted in the drawings depending on the application in question. Furthermore, it is possible to arrange the way 14 such that it is upside down compared to what is shown in the drawings, whereby the actuator 25 is in its rest position at the lower part of the wind box, and first cleans the upper edge of the air opening 3, then its centre part and finally its lower edge, as it moves along its cleaning path. In principle, it is also possible to design the air slide 16 and the guide way 14 such that the guiding of the air flow is carried out by controlling the air slide 16 such that it moves in front of the air inlet port 2, thus narrowing the flow route.

The possible position of the guide way 14 in the wind box is not limited only by the side walls of the frame 1 but these provide an advantageous and a natural support base for the way 14. Furthermore, the construction shown in the drawings is simple and functional, and in this construction the position of the guide way 14 does not constitute an obstacle limiting the design of the path of the cleaning head 15 and the members 16, 21 connected thereto.

Many variations are possible within the scope of the invention when the operating rod 21 and the air cylinder 19 are positioned. It is not advantageous in all possible embodiments for the control port of the operating rod 21 to be arranged close to the upper part of the frame 1; instead, it may be arranged e.g. in the middle section in the vertical direction of the frame 1. The air cylinder 19 can also be turned such that when the cylinder 19 pushes its shaft 20 outward, the end of the shaft 20 which is connected to the operating rod 21 moves toward the wind box and not away from it, as is the case in the embodiment depicted in the drawings. Hereby also the reverse action of the air cylinder 19, the pulling in of the shaft 20, is reversed as compared to the previous examples.

Figure 2:
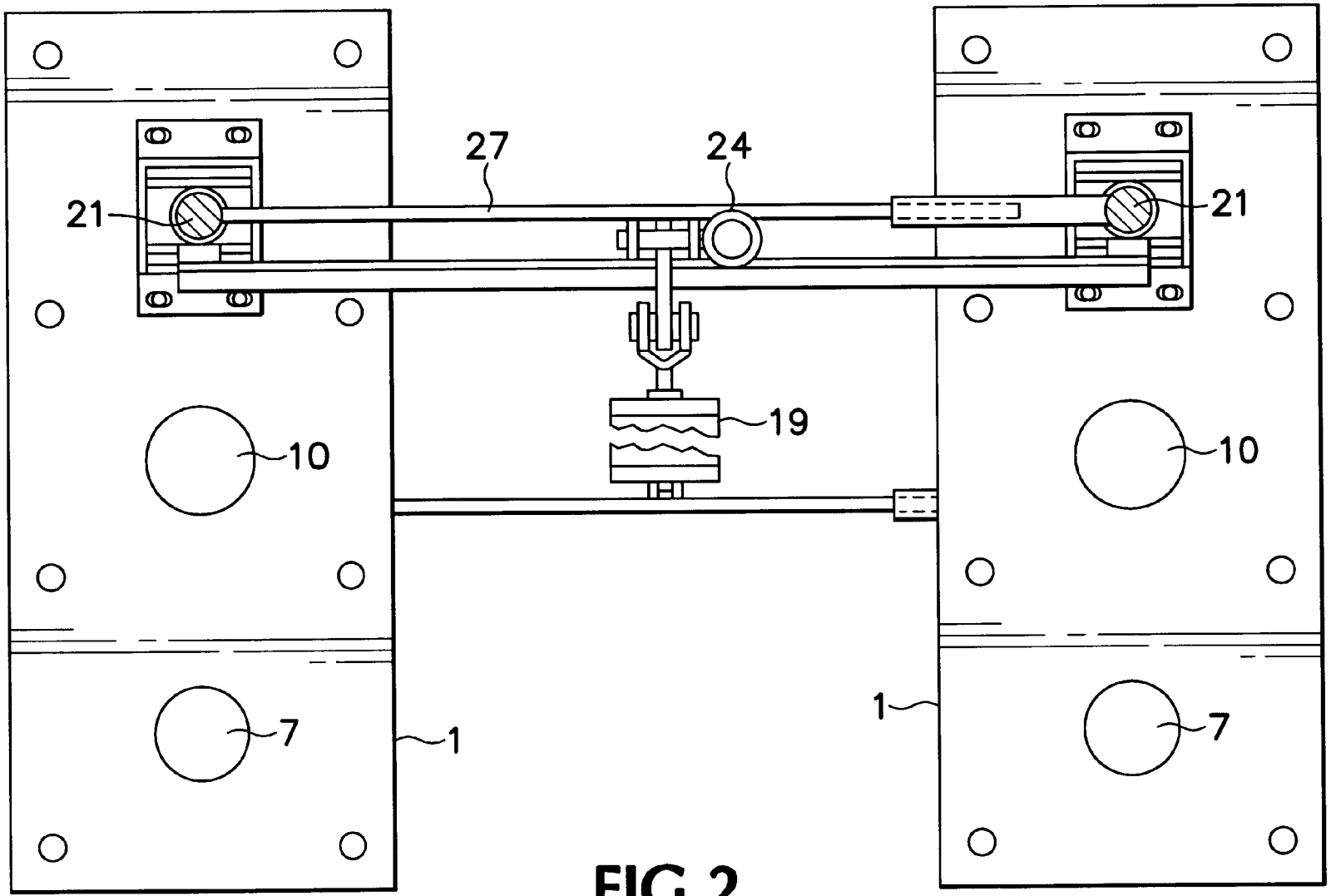
FIG. 2 depicts a group of wind boxes according to the invention.

It is also possible and in many applications preferred to use the same air cylinder 19 to control several wind boxes. In the case of two wind boxes this can be carried out as shown in FIG. 2, whereby the shaft 20 of the air cylinder 19 guides a transverse beam 27 to which the operating rods 21 of two adjacent wind boxes are connected. The air cylinder 19 can then be positioned in the space between the wind boxes whereby the space required by the wind box system in the longitudinal direction is reduced.

The wind box can also be constructed so wide that it comprises several air openings 3. Hereby a cleaning head 15 is provided for each air opening 3, but the air slide 16 may advantageously also be shared. All cleaning heads 15 of the wind box are simplest to control by means of the same air cylinder 19.

Restricting the path of the actuator 25 comprising an air slide 16 and a cleaning head 15 has been described above. This was done by means of a limiting frame 22 and a spline or pin 24 which were employed to mechanically prevent the shaft 20 from protruding further out than has been predetermined of the air cylinder 19, whereby the pulling of the operating rod 21 from inside the frame 1 was also restricted. A corresponding limiting operation can also be carried out by means of magnetic limit switches, whereby the magnetic limiters are arranged e.g. on the surface of the air cylinder 19. When the shaft 20 of the cylinder 19 has protruded a distance corresponding to the position of the limiter, the limit switch controls the actuators of the air cylinder 19 such that the shaft 20 is locked in this position. In this embodiment of the wind box mechanical limiting devices 22 and 24 are not necessarily needed.

What is claimed is:

1. A wind box intended for the air supply of a chemical recovery furnace, comprising a frame (1) having at least one air inlet opening (2) and at least one air supply opening (3) for taking air through the frame (1) to the recovery furnace, at least one at least partly curved guide way (14) which is connected to the frame, at least one actuator (25) which is arranged to be movably supported against the guide way (14) for regulating the air flow through the frame (1) and for cleaning each air supply opening (3), and means (19, 21) connected to the actuator (25) for moving the actuator (25) along the guide way (14), characterized in that each guide way (14) comprises both a section curved in a first direction and a section curved in a second direction, and the actuator (25) is arranged to be supported against each guide way (14) at least two points deviating in the direction of the guide way (14), whereby the direction of the actuator (25) follows the direction of the guide way (14) when the actuator (25) is moved along the guide way (14).

2. The wind box of claim 1, characterized in that for regulating the air flow through the wind box the guide way (14) comprises a section where the actuator (25), when stopped, is inside the frame (1) in front of the air supply opening (3) at least partially crosswise such that the path of air to the air supply opening (3) is restricted.

3. The wind box of claim 1, characterized in that both side walls of the frame (1) are provided with tracks or rails aligned with respect to each other and forming the guide way (14), or fixed pieces (12, 13) between which two essentially uniformly broad slots aligned with respect to each other form the guide way (14).

4. The wind box of claim 1, characterized in that the guide way (14) has a section arranged to guide the actuator (25) to the top part of the frame (1) in order to reduce the effect of the actuator (25) which restricts the air flow.

5. The wind box of claim 1, characterized in that the guide way (14) has a section which begins close to the lower part of the frame (1) and is steeply curved upwards, said section being situated in front of the air supply opening (3) and arranged to control the cleaning head (15) such that it sets in a motion where the cleaning head (15) moves from the lower edge of the air supply opening (3) to its upper edge.

6. The wind box of claim 1, characterized in that a rod (21) is hinged to the rear part of the actuator (25), there is an opening (11) in the back wall of the frame (1), a gasket is fitted in the opening such that it can be turned, and the rod (21) is arranged to travel through the opening (11) and the gasket.

7. The wind box of claim 6, characterized in that one end of the rod (21) is fixed to an air cylinder (19) arranged to move the actuator (25) via the transmission of the rod (21).

8. The wind box of claim 7, characterized in that, in order to restrict the movement of the cylinder (19) shaft (20) and the rod (21), the wind box comprises an elongated piece (22) which is essentially parallel to the air cylinder (19) and is provided with several holes (23) which are perpendicular to the longitudinal direction of the cylinder (19), and a spline (24) arranged to be inserted into such holes (23).

9. The wind box of claim 7, characterized in that the rod (21) is connected to the air cylinder (19) via the transmission of a transversal beam (27) to which even the corresponding rod (21) of another wind box is connected, in order to operate more than one wind box using the same air cylinder (19).

10. The wind box of claim 1, characterized in that the actuator (25) comprises a cleaning head (15) whose upper edge is essentially similar in shape to the upper edge of the air supply opening (3), lower edge is essentially similar in shape to the lower edge of the air supply opening (3), and middle part is essentially equal in width to the air supply opening (3).

11. The wind box of claim 1, characterized in that the actuator (25) comprises a cleaning head (15), an air slide (16) fixedly connected to the rear end of the cleaning head 15), and wheels (26) mounted on both sides of the air slide (16), on which wheels the actuator (25) is arranged to move along the guide way (14).

* * * * *